US006253983B1

(12) United States Patent
Dadd

(10) Patent No.: US 6,253,983 B1
(45) Date of Patent: Jul. 3, 2001

(54) VACUUM CONVEYOR

(75) Inventor: James Dadd, North Delta British Columbia (CA)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/371,129

(22) Filed: Aug. 10, 1999

(51) Int. Cl.[7] ..... B65H 20/00; D21F 3/10

(52) U.S. Cl. ..... 226/95; 226/91; 226/12; 162/193; 162/367

(58) Field of Search ..... 226/12, 91, 95, 226/170; 162/193, 209, 367

(56) References Cited

U.S. PATENT DOCUMENTS

| | | | | |
|---|---|---|---|---|
| 3,140,030 | * | 7/1964 | Stewart | 226/95 |
| 3,321,121 | * | 5/1967 | Nyberg et al. | 226/95 |
| 3,468,606 | * | 9/1969 | Wolf et al. | 226/95 X |
| 4,022,366 | | 5/1977 | Rooney . | |
| 4,763,822 | * | 8/1988 | Mohrsen | 226/95 X |
| 4,821,936 | * | 4/1989 | Osborn | 226/95 X |
| 6,003,750 | * | 12/1999 | Hermsen | 226/95 X |

FOREIGN PATENT DOCUMENTS 2636887 3/1977 (DE) .

* cited by examiner

*Primary Examiner*—Michael R. Mansen

(74) *Attorney, Agent, or Firm*—Greenblum & Bernstein, P.L.C.

(57) ABSTRACT

Apparatus and process for guiding a running web. The apparatus includes at least two guide rolls, which includes at least one driven roll, a suction box coupled to a vacuum source and having a wall with an aperture, an air-permeable belt tensioned over the at least two rolls, and the suction box being positioned within a loop formed by the belt. The suction box is positioned to suction a portion of the belt that is adapted to guide the running web. The apparatus also includes a vacuum control adapted to control a degree of vacuum in the suction box that includes a movable element positioned adjacent the aperture and an inner surface of the wall. The moving element is adapted to open and close the aperture, and an actuator is coupled to the movable element to effect the opening or closing of the aperture. The process includes applying a vacuum pressure to the suction box to decrease an internal pressure with the suction box, applying an actuator force on the movable element in a direction toward an aperture in the apertured wall, so that the movable element is located in a position to close the aperture. The process also includes guiding a transport belt over the suction box, transporting at least a portion of the material web on the transport belt, so that the suction box suctions at least a portion of the material web onto the transport belt, releasing the movable element from the aperture, so that the aperture is opened and the suction on the at least a portion of the material web is reduced, and closing the aperture with the movable element, so that the suctioning of the at least a portion of the material web onto the transport belt is increased.

27 Claims, 1 Drawing Sheet

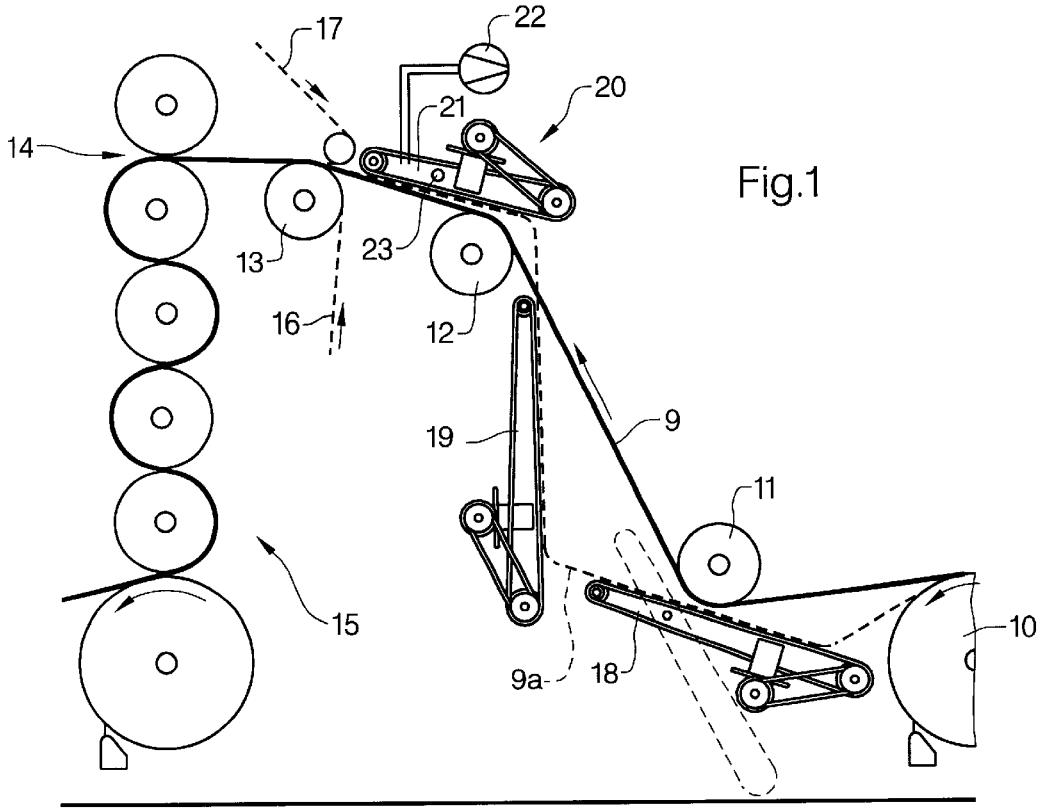
Fig.1
Fig.2
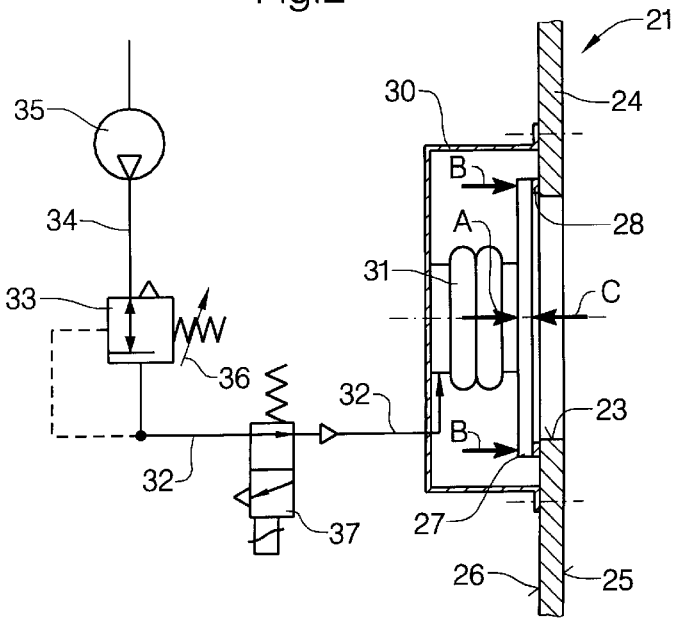
Fig.3
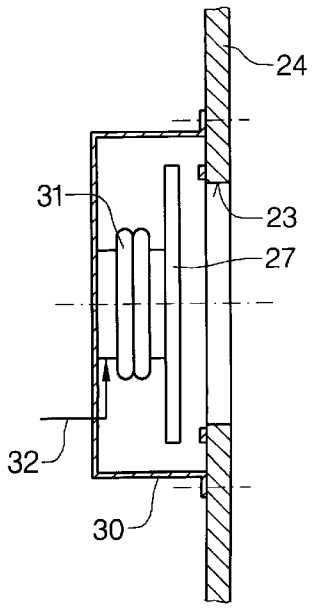

VACUUM CONVEYOR

BACKGROUND OF THE INVENTION

1. Field of the Invention

The invention relates to a vacuum conveyor for guiding a running web, e.g., a lead strip (or "threading tail"). Such a vacuum conveyor is used for transporting a web, e.g. a paper and cardboard web, from a section of a paper-making or paper-finishing machine to a following section of that machine.

2. Discussion of Background Information

A vacuum conveyor is known from DE 26 36 887 which is similar to U.S. Pat. No. 4,022,366. Conveyors of this kind have proven successful in operation. In some applications, however, a paper tail must be transferred from a vacuum conveyor to a rope nip (of a following machine section) at a very high speed (over 1500 meters/min). This requires a very rapid change of degree of the vacuum applied to the conveyor. For this purpose it is known to use a pneumatic operated damper at the vacuum source or in the vacuum line.

Recently, however, the operating speed of paper-making or paper-finishing machines is being further increased, namely up to about 2200 meters/min. Unfortunately, in such extreme high speed systems, the conventional dampers do not operate in a reliable manner.

SUMMARY OF THE INVENTION

Therefore, the invention is based on the problem of further developing the known vacuum conveyor and its vacuum control in such a way that the transfer of a tail into the ropes of a following machine section is improved, in particular at extremely high operating speeds.

In particular, the vacuum control of the instant invention includes an air-permeable endless conveyor belt that is tensioned over at least two rolls, and in which a suction box is located within the loop of the conveyor belt and is connected to a vacuum source. Further, at least one of the rolls can be driven to allow the endless conveyor belt to travel over the rolls and the suction box, so that the vacuum propagates through the run of the conveyor belt running in the direction of web travel, which draws the web to be guided onto the conveyor belt by suction. A vacuum control is adapted to establish a fast decrease of the vacuum degree in the suction box and includes a movable element positioned at an inner surface of a wall of the suction box. The wall has an aperture which may be closed by the movable element. An actuator is connected to the movable element such that, in an active state, the actuator causes movable element to close the aperture.

According to the present invention, a wall of the suction box has an aperture which may be closed by a movable element placed at the inner side of the wall. An actuator is connected to the movable element for pressing the same onto the inner side of the wall, if one desires to close the aperture, i.e. if the vacuum conveyor is in its normal operating state. In this state, the atmospheric pressure is working onto the outer side of the movable element and wants to remove the movable element from the wall (whereby the aperture would be opened). However, onto the inner side of the movable element, two forces A and B are effective against the atmosperic pressure for maintaining the aperture closed.

Force A is a variable control force or "actuator force" created by the actuator and force B is depending upon the internal pressure existing in the interior of the suction box, which is the difference between the atmospheric pressure and the actual vacuum degree. The higher the vacuum degree is, the smaller force B is. The vacuum control according to the present invention will operate in the following way: If, e.g. during a start-up of a paper-making machine, the tail of a lead strip of the paper web arrives at the vacuum conveyor for further transferring the lead strip into a rope system of a following machine section, the lead strip covers the suction openings (e.g. slots) of the conveyor. As a result the internal pressure in the suction box severely decreases, thus, preventing the lead strip from being held too firmly to the conveyor. However, the decrease of the internal pressure immediately results in a decrease of the force B, whereby the aperture, if force A had been adjusted to a relative low set value is quickly opened. Now as vacuum decreases (i.e. the internal pressure increases), the movable element again closes the aperture. Thus, a steady and relatively low vacuum degree (which is dependent upon the set value of force A) is created within an extremely short period of time. Such a rapid change of the vacuum degree (in the vacuum conveyor) will improve the transfer of the lead strip, in particular when the tail of the lead strip must be transferred into a rope system of the following machine section (e.g. calender or coating machine or reel) of a high-speed paper-making or -finishing machine.

The present invention is directed to an apparatus for guiding a running web that includes at least two guide rolls, which at least one driven roll, a suction box coupled to a vacuum source and having a wall having an aperture, an air-permeable belt tensioned over the at least two rolls, and the suction box being positioned within a loop formed by the belt. The suction box is positioned to suction to a portion of the belt that is adapted to guide the running web. The apparatus also includes a vacuum control adapted to control a degree of vacuum in the suction box that includes a movable element position adjacent the aperture and an inner surface of the wall. The moving element is adapted to open and close the aperture, and an actuator is coupled to the movable element to effect the opening or closing of the aperture.

According to a feature of the instant invention, a stationary element can be located within the suction box. The apparatus can also include a pressure source and a control line, and the actuator can include an air bag positioned between the stationary element and the movable element. A control valve can be adapted to adjustably establish a substantially constant pressure in the air bag, and an interior of the air bag may be coupled to the pressure source through the control line. Further, the control valve may be a self-relieving valve. Further still, an additional valve may be coupled to the control line which selectively couples the actuator to one of the pressure source and an outside atmosphere. Moreover, the movable element can include a plate which is coupled to the air bag, so that the plate can be adapted to contact the inner surface to close the aperture.

In accordance with another feature of the instant invention, the movable element may have an outer side adapted to be exposed to an outside atmosphere, and an inner side adapted to be exposed to an actuator force and a vacuum force within the suction box. When the actuator force and the vacuum force within the suction box is greater than the outside atmosphere, the movable element closes the aperture, and when the actuator force and the vacuum force within the suction box is less than the outside atmosphere, the movable element opens the aperture.

According to still another feature of the present invention, the running web can include a paper web. Further, the running web can include a threading strip adapted for threading the web through a machine. Still further, the running web can include a threading strip for a paper web adapted for threading a paper web through one of a production, finishing, and processing a machine.

In accordance with a further feature of the invention, the suction box may be pivotably positionable.

The present invention is also directed to an apparatus for guiding at least a portion of a paper web. The apparatus includes at least two guide rolls, which includes at least one driven roll, a suction box, which includes an apertured wall and which is coupled to a vacuum source, and an air-permeable belt guided around the at least two rolls and the suction box. The suction box is positioned to suction a portion of the belt. A vacuum control device is adapted to control a vacuum within the suction box, and includes a movable element located within the suction box and positioned adjacent the apertured wall. An actuator is coupled to the movable element to move the movable element relative to the apertured wall.

In accordance with a feature of the invention, a stationary element may be located within the suction box. Further, a pressure source and a control line can be provided. The actuator can include an air bag positioned between the stationary element and the movable element, a control valve can be adapted to adjustable establish a substantially constant pressure in the air bag, and an interior of the air bag may be coupled to the pressure source through the control line. Further, an additional valve may be coupled to the control line which selectively couples the actuator to one of the pressure source and an outside atmosphere. The movable element can include a plate which is coupled to the air bag, so that the plate may be adapted to move relative to the apertured wall. The apertured wall can include an aperture, and the plate structured to entirely cover the aperture. Still further, a sealing member can be located between the aperture and the plate, so that the sealing member prevents loss of vacuum pressure when the aperture is closed.

According to still another feature of the invention, a valve may be coupled to the movable element to purge the suction box of suction pressure.

The present invention can also include a process for guiding a material web with an apparatus that includes a suction box having an apertured wall, a vacuum source coupled to the suction box, a vacuum control device adapted to control a vacuum pressure within the suction box that includes a movable element located within the suction box and positioned adjacent the apertured wall, and an actuator coupled to the movable element to move the movable element relative to the apertured wall. The process includes applying a vacuum pressure to the suction box to decrease an internal pressure with the suction box, applying an actuator force on the movable element in a direction toward an aperture in the apertured wall, so that the movable element is located in a position to close the aperture. The process also includes guiding a transport belt over the suction box, transporting at least a portion of the material web on the transport belt, so that the suction box suctions at least a portion of the material web onto the transport belt, releasing the movable element from the aperture, so that the aperture is opened and the suction on the at least a portion of the material web is reduced, and closing the aperture with the movable element, so that the suctioning of the at least a portion of the material onto the transport belt is increased.

According to a feature of the invention, the movable element can include a plate having an inner surface directed toward an interior of the suction box and an outer surface toward the aperture, and, when a force on the inner surface, which includes the actuator force, is greater than a force on the outer surface, the plate can be moved to close the aperture. Further, the force on the inner surface can further include a force dependent upon the internal pressure of the suction box, and the force on the outer surface can be dependent upon an atmosphere outside of the suction box.

In accordance with another feature of the present invention, the suction box can include suction slits directed toward the transport belt, and, when the at least a portion of the material web covers some of suction slits, the internal pressure of the suction box decreases, so that the movable element is released from the aperture. When the movable element is released from the aperture, the internal pressure of the suction box increases, so that the movable element re-covers the aperture.

According to yet another feature of the present invention, the apparatus may further include a purge valve coupled to the movable element, and the process can further include purging the suction box of suction pressure by opening the purge valve.

BRIEF DESCRIPTION OF THE DRAWING

In the drawing which illustrates an embodiment of the invention,

FIG. 1 schematically illustrates two sections of a paper-making machine, which includes vacuum conveyors located therebetween; and FIGS. 2 and 3 illustrate a vacuum control system of the vacuum conveyors depicted in FIG. 1.

DESCRIPTION OF PREFERRED EMBODIMENT

According to FIG. 1, a paper web 9 is travelling through the final sections of a paper-making machine. The web leaves the last roll 10 or cylinder of a preceding section and is guided by paper rolls 11, 12 and 13 to the first roll nip 14 of a calender 15. At the paper roll 13, which is positioned close to roll nip 14, two ropes 16 and 17 form a rope nip in a manner known in the art.

During start-up of the machine or after an interruption of the paper-making process, the paper web must be threaded from section to section of the machine and through each of the sections, e.g. through the calender 15. For that purpose, at first a narrow edge strip or lead strip (separated from the web by a cutting device) is transferred via vacuum belt conveyors 18, 19, 20 along a path 9*a* (illustrated by a dotted line) into the rope nip at roll 13. Thereafter the ropes 16, 17 transfer the lead strip through the calender. Then, in a known manner, the lead strip is widened up to the full width of the web.

Each of the vacuum conveyors 18, 19, 20 comprises an endless perforated belt travelling over two rolls or pulleys. Between these pulleys, there is a suction box 21 connected to a vacuum source 22. One of the pulleys can be driven by a conventional motor.

For the control of the vacuum degree within the suction box 21, control elements as shown in FIGS. 2 and 3 are disposed at an aperture 23 of a side wall 24 of the suction box. The external surface of side wall 24 is designated as 25, while the internal surface of side wall 24 is designated as 26.

Close to the internal surface 26 of side wall 24, a movable element 27 (e.g. in form of a plate) is installed which covers the aperture 23 and is therefore designated to close the same. A sealing element 28 may be arranged between plate 27 and side wall 24. A support 30 (e.g. in form of a box) is fixed to the internal surface 26 of side wall 24. To this support 30, one end of an actuator 31 (e.g. in form of an air bag) is connected. The outer end of that actuator 31 supports the movable element 27.

The interior of air bag 31 is connected to an air pressure supply 35 via line 32, pressure control valve 33 and line 34. In this manner, whereby air bag 31 creates a variable control force or "actuator force A". Valve 33 holds said actuator force A at an adjustable set value. Valve 33 is, e.g., self-relieving if the set value is decreased as symbolically illustrated by an arrow 36.

In operation, vacuum source 22 creates in box 21 an internal pressure which is lower than the atmospheric pressure.

Plate 27 closes the aperture 23 as shown in FIG. 2, if the actuator force A plus a force B (dependent upon the internal pressure) is greater than a force C (dependent upon the atmospheric pressure). Thus, force C acts on the outer side of plate 27, while forces A and B act on the inner side of plate 27.

If (as described above) force B suddenly decreases, then force C will exceed the sum of forces A and B and, therefore, will open the aperture 23 (as shown in FIG. 3). As a result, the internal pressure will immediately increase (i.e. the vacuum degree will immediately decrease), and plate 27 will close the aperture 23.

To completely purge vacuum from conveyor box 21, such as when no vacuum is to act on the paper web, e.g., when the ropes have total control of the paper web, actuator 31 can be completely deactivated by energizing a solenoid valve 37 (purge valve), that connects the interior of actuator 31 to the atmosphere.

What is claimed is:

1. An apparatus for guiding a running web comprising:

at least two guide rolls, which includes at least one driven roll;

a suction box coupled to a vacuum source and comprising a wall having an aperture;

an air-permeable belt tensioned over said at least two rolls;

said suction box being positioned within loop formed by said belt;

said suction box being positioned to suction a portion of said belt that is adapted to guide the running web;

a vacuum control adapted to control a degree of vacuum in said suction box and comprising a movable element positioned adjacent said aperture and an inner surface of said wall, said moving element being adapted to open and close said aperture;

an actuator being coupled to said movable element to effect at least one of the opening and closing of said aperture;

a stationary element located within said suction box;

a pressure source; and a control line;

said actuator comprising an air bag positioned between said stationary element and said movable element;

a control valve adapted to adjustable establish a substantially constant pressure in said air bag; and an interior of said air bag being coupled to said pressure source through said control line.

2. The apparatus in accordance with claim 1, wherein said control valve is a self-relieving valve.

3. The apparatus in accordance with claim 1, further comprising an additional valve coupled to said control line which selectively couples said actuator to one of said pressure source and an outside atmosphere.

4. The apparatus in accordance with claim 1, said movable element comprising a plate which is coupled to said air bag, whereby said plate is adapted to contact said inner surface to close said aperture.

5. An apparatus for guiding a running web comprising:

at least two guide rolls, which includes at least one driven roll;

a suction box coupled to a vacuum source and comprising a wall having an aperture;

an air-permeable belt tensioned over said at least two rolls;

said suction box being positioned within a loop formed by said belt;

said suction box being positioned to suction a portion of said belt that is adapted to guide the running web;

a vacuum control adapted to control a degree of vacuum in said suction box and comprising a movable element positioned adjacent said aperture and an inner surface of said wall, said moving element being adapted to open and close said aperture; and an actuator being coupled to said movable element to create a variable control force and to effect at least one of the opening and closing of said aperture.

6. The apparatus in accordance with claim 5, said movable element having an outer side adapted to be exposed to an outside atmosphere, and an inner side adapted to be exposed to an actuator force and a vacuum force within said suction box.

7. The apparatus in accordance with claim 6, wherein, when the actuator force and the vacuum force within said suction box is greater than the outside atmosphere, the movable element closes said aperture.

8. The apparatus in accordance with claim 6, wherein, when the actuator force and the vacuum force within said suction box is less than the outside atmosphere, the movable element opens said aperture.

9. The apparatus in accordance with claim 5, wherein said running web comprises one of a paper and cardboard web.

10. The apparatus in accordance with claim 5, wherein said running web comprises a threading strip adapted for threading said web through a machine.

11. The apparatus in accordance with claim 5, wherein said running web comprises a threading strip for a paper web adapted for threading a paper web through one of a production, finishing, and processing a machine.

12. The apparatus in accordance with claim 5, wherein said suction box is pivotably positionable.

13. The apparatus in accordance with claim 5, wherein said actuator comprises an air bag.

14. An apparatus for guiding at least a portion of a paper web, comprising:

at least two guide rolls, which includes at least one driven roll;

a suction box comprising an apertured wall, said suction box being coupled to a vacuum source;

an air-permeable belt guided around said at least two rolls and said suction box;

said suction box being positioned to suction a portion of said belt;

a vacuum control device adapted to control a vacuum within said suction box, said vacuum control device comprising a movable element located within said suction box and positioned adjacent said apertured wall;

an actuator being coupled to said movable element to create a variable control force to move said movable element relative to said apertured wall.

15. The apparatus in accordance with claim 14, further comprising a valve coupled to said movable element to purge the suction box of suction pressure.

16. The apparatus in accordance with claim 14, wherein said actuator comprises an air bag.

17. An apparatus for guiding at least a portion of a paper web, comprising:

at least two guide rolls, which includes at least one driven roll;

a suction box comprising an apertured wall, said suction box being coupled to a vacuum source;

an air-permeable belt guided around said at least two rolls and said suction box;

said suction being positioned to suction a portion of said belt;

a vacuum control device adapted to control a vacuum within said suction box, said vacuum control device comprising a movable element located within said suction box and positioned adjacent said apertured wall;

an actuator being coupled to said movable element to move said movable element relative to said apertured wall;

a stationary element located within said suction box;

a pressure source; and a control line;

said actuator comprising an air bag positioned between said stationary element and said movable element;

a control valve adapted to adjustable establish a substantially constant pressure in said air bag; and an interior of said air bag being coupled to said pressure source through said control line.

18. The apparatus in accordance with claim 17, further comprising an additional valve coupled to said control line which selectively couples said actuator to one of said pressure source and an outside atmosphere.

19. The apparatus in accordance with claim 17, wherein said movable element comprises a plate which is coupled to said air bag, whereby said plate is adapted to move relative to said apertured wall.

20. The apparatus in accordance with claim 19, wherein said apertured wall comprises an aperture, wherein said plate is structured to entirely cover said aperture.

21. The apparatus in accordance with claim 20, further comprising a sealing member located between said aperture and said plate, whereby said sealing member prevents loss of vacuum pressure when said aperture is closed.

22. A process for guiding a material web with an apparatus that includes a suction box having an aperture wall, a vacuum source coupled to the suction box, a vacuum control device adapted to control a vacuum pressure within the suction box that includes a movable element located within the suction box and positioned adjacent the apertured wall, and an actuator coupled to the movable element to move the movable element relative to the apertured wall, the process comprising:

applying a vacuum pressure to the suction box to decrease an internal pressure with the suction box;

applying, with the actuator, a variable control force on the movable element in a direction toward an aperture in the apertured wall, whereby the movable element is located in a position to close the aperture;

guiding a transport belt over the suction box;

transporting at least a portion of the material web on the transport belt, whereby the suction box suctions at least a portion of the material web onto the transport belt;

releasing the movable element from the aperture, whereby the aperture is opened and the suction on the at least a portion of the material web is reduced; and closing the aperture with the movable element, whereby the suctioning of the at least a portion of the material web onto the transport belt is increased.

23. The process in accordance with claim 22, wherein the movable element comprises a plate having an inner surface directed toward an interior of the suction box and an outer surface directed toward the aperture, and wherein, when a force on the inner surface, which includes the variable control force applied by the actuator, is greater than a force on the outer surface, the plate is moved to close the aperture.

24. The process in accordance with claim 23, wherein the force on the inner surface further includes a force dependent upon the internal pressure of the suction box, and wherein the force on the outer surface is dependent upon an atmosphere outside of the suction box.

25. The process in accordance with claim 22, wherein the suction box includes suction slits directed toward the transport belt, and wherein when the at least a portion of the material web covers some of the suction slits, the internal pressure of the suction box decreases, whereby the movable element is released from the aperture.

26. The process in accordance with claim 25, wherein, when the movable element is released from the aperture, the internal pressure of the suction box increases, whereby the movable element re-covers the aperture.

27. The process in accordance with claim 22, wherein the apparatus further comprises a purge valve coupled to the actuator, and the process further comprises:

purging the suction box of suction pressure by opening the purge valve.

* * * * *